US007324659B2

(12) United States Patent
Funahashi et al.

(10) Patent No.: US 7,324,659 B2
(45) Date of Patent: Jan. 29, 2008

(54) SPEAKER AND METHOD OF MANUFACTURING THE SAME

(75) Inventors: Osamu Funahashi, Takatsuki (JP); Hiroyuki Morimoto, Mie (JP); Yukio Okamoto, Matsusaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 604 days.

(21) Appl. No.: 10/960,959

(22) Filed: Oct. 12, 2004

(65) Prior Publication Data

US 2005/0078849 A1 Apr. 14, 2005

(30) Foreign Application Priority Data

Oct. 14, 2003 (JP) ..... 2003-353120

(51) Int. Cl.
*H04R 1/00* (2006.01)

(52) U.S. Cl. ..... 381/398; 381/403; 381/404

(58) Field of Classification Search ..... 381/398, 381/396, 403, 404, 405, 189, 397, 431, 432, 381/412, 407, 420; 181/171–173, 163–165
See application file for complete search history.

(56) References Cited

U.S. PATENT DOCUMENTS

| | | | | |
|---|---|---|---|---|
| 6,031,925 | A * | 2/2000 | Shteyn | 381/401 |
| 6,095,280 | A * | 8/2000 | Proni | 181/171 |
| 2003/0185415 | A1 | 10/2003 | Funahashi et al. | |
| 2005/0078849 | A1* | 4/2005 | Funahashi et al. | 381/412 |
| 2005/0201588 | A1* | 9/2005 | Funahashi et al. | 381/423 |

FOREIGN PATENT DOCUMENTS

| | | |
|---|---|---|
| JP | 2004-7331 | 1/2004 |

* cited by examiner

*Primary Examiner*—Curtis Kuntz
*Assistant Examiner*—Tuan Duc Nguyen
(74) *Attorney, Agent, or Firm*—Wenderoth, Lind & Ponack, L.L.P.

(57) ABSTRACT

A frame is provided with an opening allowing insertion of a jig for setting an inner rim of a suspension holder to a proper position. The jig ensures positive alignment of the suspension holder when making connection to the frame. The jig also ensures reliable bonding of a diaphragm to the suspension holder with a bonding agent, since it steadily supports the suspension holder in position during the bonding process. The positioning of the bobbin and a voice coil is thus reliable when being assembled, thereby improving acoustic performance of a speaker.

25 Claims, 10 Drawing Sheets

SPEAKER AND METHOD OF MANUFACTURING THE SAME

BACKGROUND OF THE INVENTION

1. Field of the Invention

The present invention relates to a speaker having a suspension holder, and a method of manufacturing the same.

2. Background Art

FIG. 17 is a sectional view of a conventional speaker. This speaker has magnetic circuit 55, bobbin 58, diaphragm 59, frame 62 and suspension holder 63. Magnetic circuit 55 is constructed of annular magnet 51, annular plate 52, discoid yoke 53 and cylindrical pole 54. Bobbin 58 has voice coil 57 placed inside magnetic gap 56. An inner perimeter of diaphragm 59 is connected to an outer periphery of bobbin 58. An outer perimeter of diaphragm 59 is connected to frame 62 through first surround 60. Suspension holder 63 supports diaphragm 59 and is connected to frame 62 through second surround 61.

This structure can substantially reduce a weight of suspension holder 63. That is, an overall area of suspension holder 63 can be decreased because it is connected to diaphragm 59, instead of it being connected directly to bobbin 58. As a result, the weight of suspension holder 63 is substantially lightened. A speaker of such kind is disclosed in Japanese Patent Unexamined Publication, No. 2004-7331, for example.

In the conventional structure described above, however, the presence of diaphragm 59 obstructs a worker from observing an area where diaphragm 59 and suspension holder 63 are bonded with adhesive when assembling the speaker. This gives rise to a possibility of causing misalignment of a certain extent in position of voice coil 58 in relation to diaphragm 59. If there is a positional misalignment of bobbin 58 connected to diaphragm 59 or voice coil 57 disposed to bobbin 58 as stated above, it results in degradation of acoustic characteristic of the speaker.

SUMMARY OF THE INVENTION

A speaker of the present invention has a magnetic circuit having a magnetic gap, a bobbin, a diaphragm, a frame, a suspension holder, a bonding agent, a first surround and a second surround. The bobbin has a voice coil disposed inside the magnetic gap. An inner perimeter of the diaphragm is bonded to an outer periphery of the bobbin. An outer perimeter of the diaphragm is connected to the frame via the first surround. The suspension holder supports the diaphragm on its inner rim, and an outer rim is connected to the frame via the second surround. The bonding agent bonds the inner rim of the suspension holder to the diaphragm. The frame has an opening in a position corresponding to an area of the bonding agent. In this structure, the opening provided in the frame allows insertion of a jig for guiding the inner rim of the suspension holder to a proper position. As a result, the suspension holder is properly aligned when it is connected to the frame, and the suspension holder thus stays steady when the diaphragm is fixed to it with the bonding agent. This ensures accurate positioning of the bobbin and the voice coil when being fixed, so as to prevent degradation of the acoustic characteristic of the speaker. In addition, since this structure brings a phase of the diaphragm into substantially equal to that of the suspension holder, it can reduce resonance distortion in the mid- to low-frequency ranges, which is attributable to a difference between their phases, and flatten the frequency characteristic. Accordingly, the present invention can improve the acoustic characteristic of the speaker. In addition, this invention discloses a method of manufacturing the speaker using the jig inserted through the opening as discussed above.

DETAILED DESCRIPTION OF THE INVENTION

Figure 1:
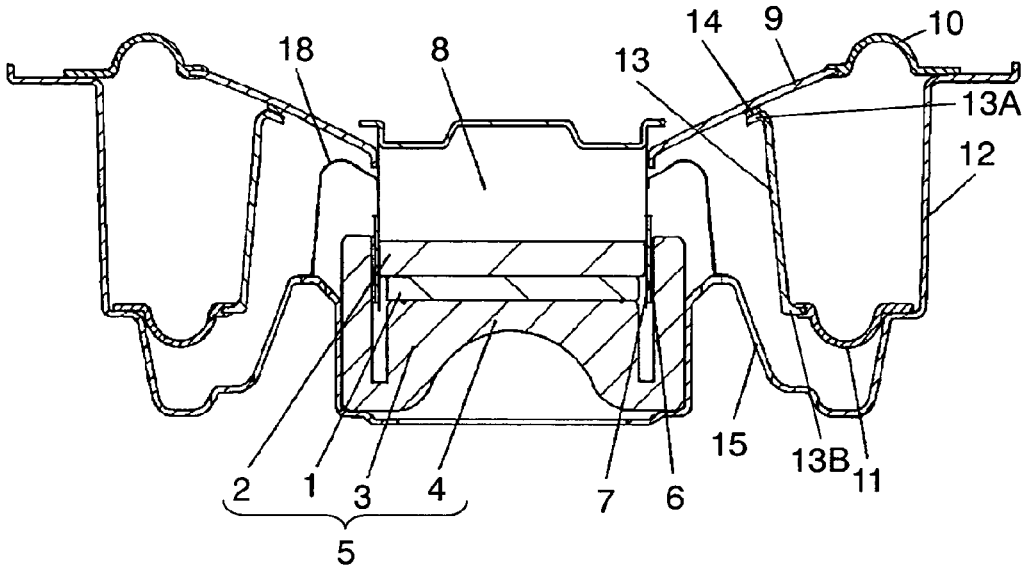
FIG. 1 is a sectional view of a speaker according to a first exemplary embodiment of the present invention.

Description is provided hereinafter of exemplary embodiments of the present invention with reference to the accompanying drawings. In each of the exemplary embodiments, same reference numerals are used throughout to designate components of like structures and like functions as those of the preceding exemplary embodiment(s), and detailed description of them will be omitted.

First Exemplary Embodiment

Figure 2:
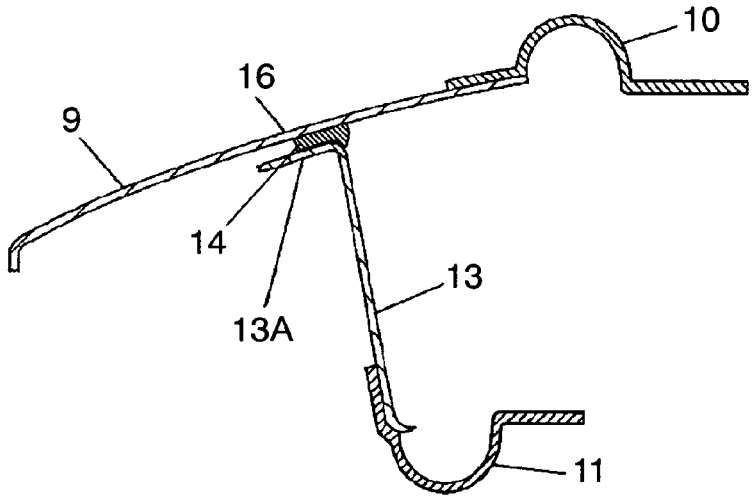
FIG. 2 is an enlarged sectional view of the speaker shown in FIG. 1, depicting a portion where a diaphragm and a suspension holder are bonded.

FIG. 1 is a sectional view of a speaker according to the first exemplary embodiment of this invention. FIG. 2 is an enlarged sectional view of the speaker shown in FIG. 1, depicting a portion and the vicinity where diaphragm 9 and suspension holder 13 are bonded. The speaker of this exemplary embodiment has magnetic circuit 5, bobbin 8, diaphragm 9, frame 12, suspension holder 13 and bonding agent 14. Magnetic circuit 5 has discoid magnet 1, discoid plate 2, discoid yoke 3 and cylindrical pole 4. Bobbin 8 is provided on its inner periphery with voice coil 7 disposed in magnetic gap 6. An inner perimeter of saucer-like diaphragm 9 is connected to an outer periphery of bobbin 8. Cylindrical frame 12 having a closed bottom makes up an exterior enclosure of the speaker, retains magnetic circuit 5 therein, and is connected to an outer perimeter of diaphragm 9 through first surround 10. Suspension holder 13 of generally a cylindrical shape having a smaller diameter at the upper side than the lower side is located inside frame 12, and supports diaphragm 9 with its inner rim 13A while its outer rim 13B is connected to frame 12 through second surround 11. Bonding agent 14 composed of adhesive or the like material secures inner rim 13A of suspension holder 13 to diaphragm 9. Besides, frame 12 has openings 15 in positions of the bottom area corresponding to bonding agent 14 for insertion of a jig.

It is desirable that both first surround 10 and second surround 11 are substantially similar in shape and arranged symmetrically with respect to each other across a mid space between them. In this exemplary embodiment, first surround 10 is formed to bulge in a direction opposite magnetic circuit 5, and second surround 11 is formed to bulge in a direction toward the bottom side of magnetic circuit 5. In this case, it is desirable that both first surround 10 and second surround 11 are substantially equal in their modulus of elasticity.

Inner rim 13A (i.e., the upper side having a smaller diameter) of suspension holder 13 is bonded to bonding portion 16 on a lower surface at a mid area of diaphragm 9. This can achieve a substantial reduction in weight of suspension holder 13 as compared to the conventional structure in which a suspension holder is bonded directly to a bobbin. Besides, bonding agent 14 is used to bond the two components. It is desirable that the bonding is made primarily in an area around outer boundary of inner rim 13A of suspension holder 13 closer to the side of frame 12. This arrangement prevents bonding agent 14, normally of a fluid adhesive, from getting into magnetic gap 6 even if it drips down below. Furthermore, bonding portion 16 may be located even more close toward diaphragm 9 than that shown in FIG. 2. It is also desirable that bonding agent 14 is made of a silicone-base adhesive.

Outer rim 13B (i.e., the lower side having a larger diameter) of suspension holder 13 is connected to frame 12 through second surround 11 at the side corresponding to the bottom of yoke 3 rather than the side near plate 2. There is dustproof net 18 placed between suspension holder 13 and magnetic circuit 5.

Figure 3:
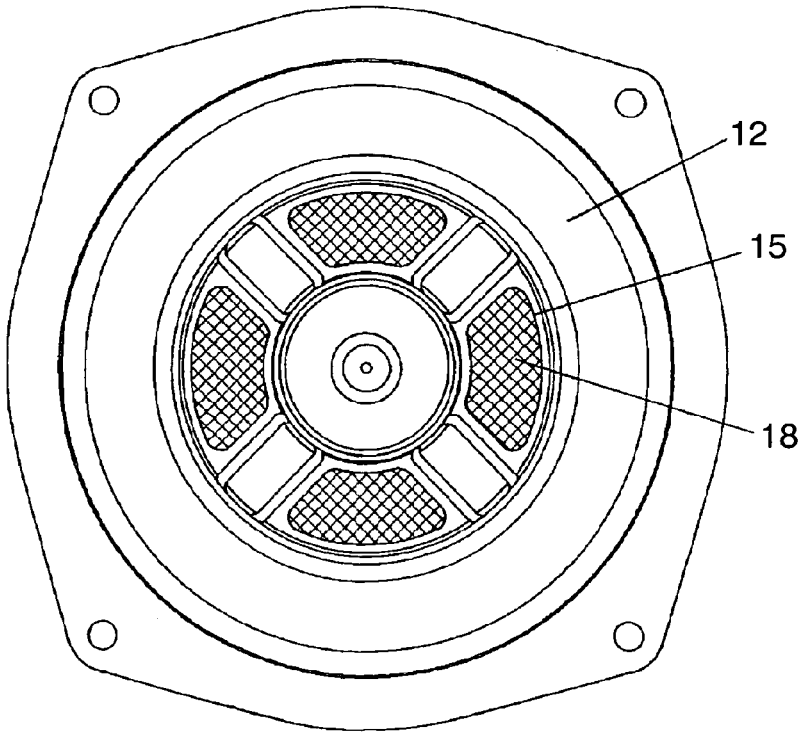
FIG. 3 is a rear view of the speaker shown in FIG. 1.

FIG. 3 is a rear view of the speaker shown in FIG. 1. Openings 15 of frame 12 are covered with dustproof nets 18.

Figure 4:
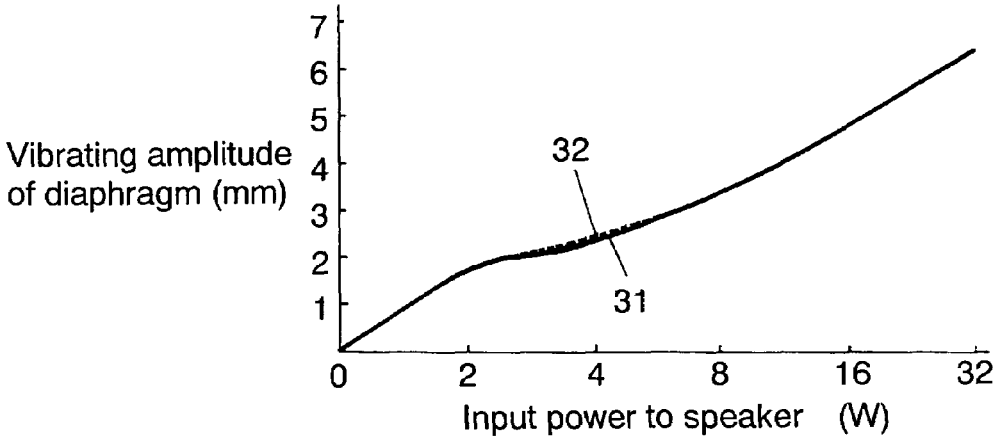
FIG. 4 is a graph representing a characteristic of power linearity of the speaker shown in FIG. 1.

FIG. 4 is a graph representing a characteristic of power linearity of the speaker shown in FIG. 1. That is, FIG. 4 shows vibrating amplitude of diaphragm 9 in response to input signal. Curve 31 indicates a characteristic of vibrating amplitude versus input signal of a polarity for driving diaphragm 9 toward the rear side of the speaker. Curve 32 indicates another characteristic of vibrating amplitude versus input signal of an opposite polarity for driving diaphragm 9 toward the front side of the speaker.

Figure 5:
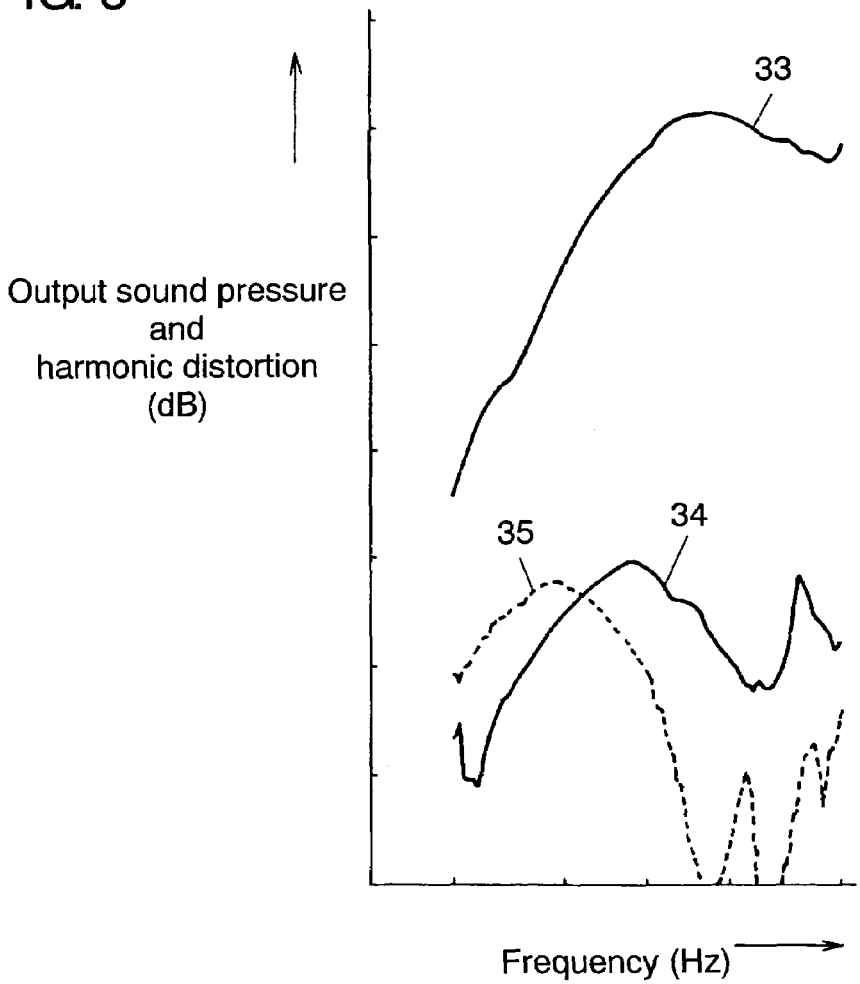
FIG. 5 is a graph representing characteristics of output sound pressure and harmonic distortion of the speaker shown in FIG. 1.

FIG. 5 is a graph representing characteristics of output sound pressure and harmonic distortion of the speaker shown in FIG. 1. In FIG. 5, what is shown is the fact that the larger the dynamic range of output sound pressure and harmonic distortion, the smaller the harmonic distortion the speaker produces. Curve 33 indicates the characteristic of output sound pressure, curve 34 indicates the characteristic of second harmonic distortion, and curve 35 indicates the characteristic of third harmonic distortion.

The speaker constructed as described above has the first through the seventh features described hereinafter.

First, frame 12 is provided with openings 15, which make possible to have jig 24 inserted therethrough to guide inner rim 13A of suspension holder 13 into proper position (to be described later with reference to FIG. 6). Therefore, suspension holders 13 can be aligned properly when it is connected to frame 12. In addition, suspension holder 13 is kept steady while diaphragm 9 is being bonded to it securely with bonding agent 14. This structure can thus ensure accurate positioning of bobbin 8 and voice coil 7 when fixed, so as to prevent degradation of acoustic characteristics of the speaker.

In addition, since this structure brings a phase of diaphragm 9 into substantially same phase with suspension holder 13, it can reduce a resonance distortion in the mid- to low-frequency ranges which is attributable to a difference between the phases of diaphragm 9 and suspension holder 13, and flatten the frequency characteristic. As a result, it can further improve the acoustic characteristics of the speaker.

Secondly, bonding agent 14 of the silicon-base adhesive used between diaphragm 9 and suspension holder 13 can accurately secure suspension holder 13 to diaphragm 9, and avoid diaphragm 9 from shifting in position. In other words, this method of bonding positively prevents bobbin 8 connected to diaphragm 9 and voice coil 7 attached to bobbin 8 from shifting in their positions, and thereby it improves the acoustic characteristics of the speaker.

Both diaphragm 9 and suspension holder 13 individually have dimensional variations resulted in the course of manufacturing. They may cause a gap between diaphragm 9 and suspension holder 13 at bonding portion. The use of bonding agent 14 can fill up this gap. Moreover, elasticity of bonding agent 14 prevents diaphragm 9 and suspension holder 13 from structural deformation, and thereby improves the acoustic characteristics of the speaker.

It is desirable that bonding portion 16 is located near the outer peripheral side of diaphragm 9. In this way, there improves rigidness of diaphragm 9 because the location of bonding portion 16 is close to a boundary of diaphragm 9 where the rigidity generally decreases.

Thirdly, suspension holder 13 and second surround 11 in combination with first surround 10 compose a suspension between bobbin 8 and frame 12. In other words, magnetic circuit 5 is composed of plate 2, magnet 1 and yoke 3 laid up in this order from the side of diaphragm 9, and outer rim 13B of suspension holder 13 is connected through second surround 11 to frame 12 at a position closer to the bottom side of yoke 3 and farther than the plate 2 side of magnetic circuit 5. This structure can prevent rolling motion of voice coil 7 when it is driven. For this reason, this structure does not require a damper, which is normally employed in the conventional suspension, and thereby it can eliminate the primary cause of nonlinearity and asymmetry.

Fourthly, first surround 10 bulges in the direction opposite magnetic circuit 5, and second surround 11 bulges toward the bottom side of magnetic circuit 5. This structure thus cancels the asymmetry in shape between first surround 10 and second surround 11. Therefore, the structure fundamentally solves problems associated with nonlinearity and asymmetry of the suspension as is evident from the curves 31 and 32 in FIG. 4. In addition, the structures of first surround 10 and second surround 11 can avoid them from coming in contact with each other in their vibrating motion even if they are physically located in close proximity to each other. They therefore provide an enough space for large amplitude of vibrations, which can increase the maximum level of sound pressure producible by the speaker.

Fifthly, both first surround 10 and second surround 11 are made substantially equal in the modulus of elasticity. Therefore, second surround 11 accurately cancels the nonlinearity of first surround 10. This greatly rectifies the asymmetry of the suspension, decreases harmonic distortion of the speaker attributable to it, and improves the power linearity.

It is also desirable that diaphragm 9 is so made that the outer side from bonding portion 16 linking diaphragm 9 to suspension holder 13 has a lower density than that of the inner side. Since this keeps a good balance between rigidity and a mass of diaphragm 9 as a whole, it can reduce the weight while maintaining the rigidity. As a result, it obviates degradation in efficiency (i.e., decrease in sound pressure) of the speaker.

Sixthly, dustproof net 18 provided between suspension holder 13 and magnetic circuit 5 keeps dust and the like from getting into magnetic gap 6.

Seventhly, the outer rim of suspension holder 13 is connected to frame 12 through second surround 11 at the side corresponding to the bottom of yoke 3 rather than the upper side of plate 2. This structure improves the acoustic characteristics of the speaker. In other words, the structure can prevent rolling motion of voice coil 7 to the maximum extent possible when being driven since it can make use of a full dimension of the speaker to maintain a distance between fulcrums of first surround 10 and second surround 11. A original point of moving bobbin 8 lies between the two fulcrums of bobbin 8, of which one is a connecting point of first surround 10 to frame 12 and the other is a connecting point of second surround 11 to frame 12. Since moving bobbin 8 and these fulcrums form a triangle, this structure can stably support the bobbin 8 when being driven.

Because of the reasons described above, the speaker of this exemplary embodiment has a high degree of acoustic characteristics as shown in FIG. 5. This feature is apparent from the curve 33. In addition, the speaker of this exemplary embodiment achieves reduction of harmonic distortion attributable to the nonlinearity and asymmetry of the suspension, as shown by the curves 34 and 35.

Description is provided next of materials used for the individual components of the speaker according to this exemplary embodiment.

First surround 10 and second surround 11 can be made by using such materials as urethane, rubber, foamed rubber, cloth and the like. In this exemplary embodiment here, they are made of urethane formed into a ridge having a semi-spherical shape in cross section. Frame 12 is cylindrical in shape with a closed bottom, and uses any of machine-pressed steel plate, molded plastic resin, die-cast aluminum and the like. To produce bobbin 8, any material is suitable such as paper, plastic resin, metallic material like aluminum and the like. Suspension holder 13 can be produced with any of pulp, plastic resin and metallic materials. It is also desirable to use a silicone-base adhesive for bonding agent 14, as stated previously.

The individual components produced with the materials described above provide the following features. While it is important for first surround 10 and second surround 11 not to impress an undue load on the moving motion of diaphragm 9, use of urethane can improve efficiency of the speaker since this material can make elastic deformation and remove an extra weight from the vibration system. Alternatively, first surround 10 and second surround 11 may be made with common rubber or foam rubber. In this case, a level of compliancy of first surround 10 and second surround 11 can be controlled freely even if the speaker has no damper, so as to adjust the lowest resonance frequency "fo" to an optimum value.

Frame 12 can be formed into any complex shape to meet the necessity by using the machine-pressed steel plate, molded plastic resin, die-cast aluminum and the like.

Suspension holder 13 made of such material as pulp and plastic resin achieves both high rigidity and optimum level of internal loss. Use of a lightweight material as mentioned above can limit an increase in weight of the speaker even though it has first surround 10 and second surround 11. As a result, this improves an efficiency of the speaker. Moreover, a metallic material of high thermal conductivity such as aluminum, when used for bobbin 8 and suspension holder 13, efficiently dissipates heat generated by voice coil 7 through bobbin 8 and suspension holder 13. It therefore increases the maximum permissible power input to the speaker.

Although the speaker of this exemplary embodiment is illustrated as having magnetic circuit 5 of an inner magnet structure, it may be of an outer magnet structure.

Figure 6:
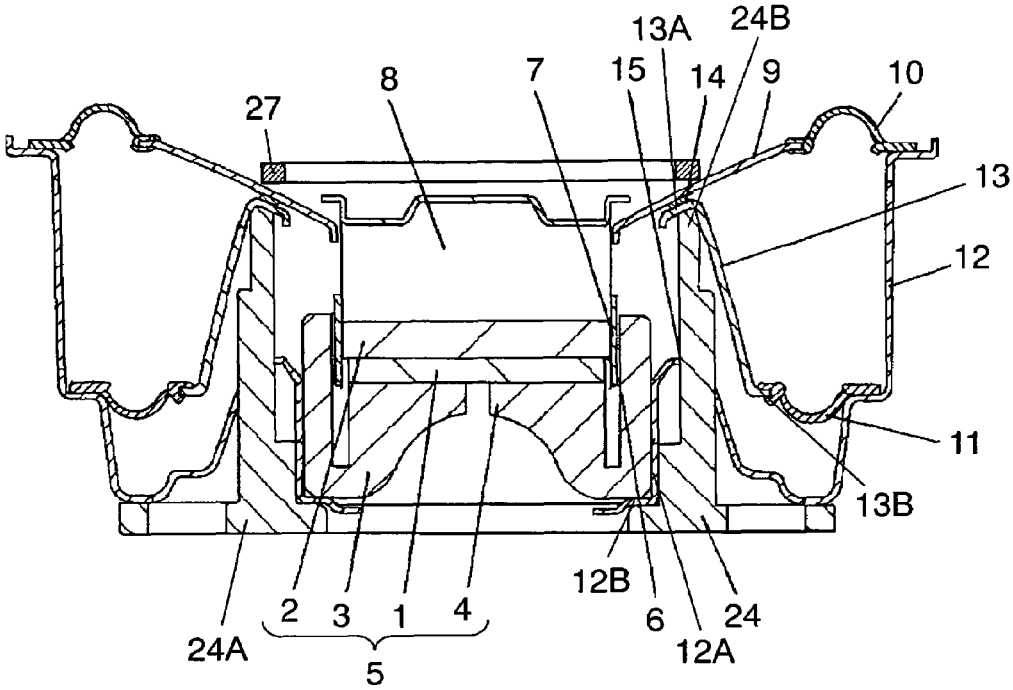
FIG. 6 is a sectional view of the speaker showing a method of manufacturing the same according to the first exemplary embodiment of this invention.
Figure 7A:
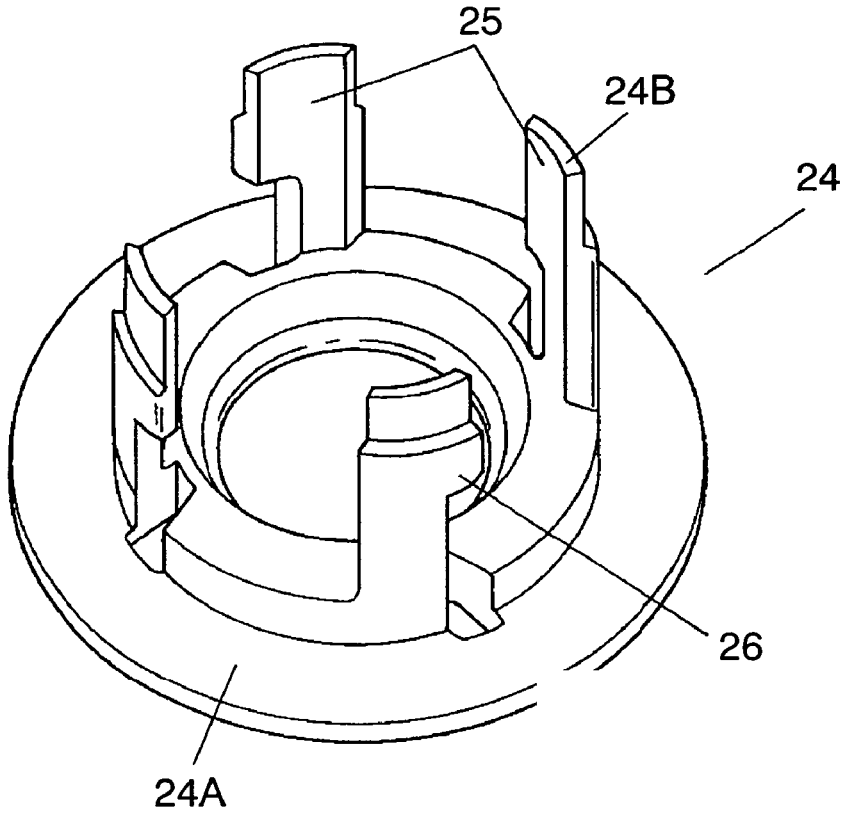
FIG. 7A is a perspective view of a jig shown in FIG. 6.
Figure 7B:
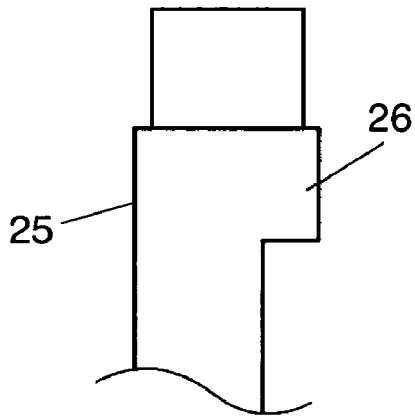
FIG. 7B is an enlarged view of a protruding portion of the jig shown in FIG. 6.

Referring now to FIG. 6, FIG. 7A and FIG. 7B, description is provided hereinafter of a method of manufacturing the speaker according to this exemplary embodiment. FIG. 6 is a sectional view of the speaker representing the manufacturing method, FIG. 7A is a perspective view of a jig shown in FIG. 6, and FIG. 7B is an enlarged view of a protruding portion of the jig.

In the method of manufacturing the speaker according to this exemplary embodiment, frame 12 is secured first to jig 24 by inserting jig 24 into openings 15 of frame 12. An open area of each of openings 15 is larger than a sectional area of a head of each of protruding portions of jig 24 so as to facilitate insertion of jig 24. This also prevents jig 24 from being damaged by burrs and the like around openings 15 when it is inserted through openings 15, and thereby it improves productivity of the speaker. Next, while inner rim 13A of suspension holder 13 is kept supported on jig 24, outer rim 13B of suspension holder 13 is fixed to frame 12 through second surround 11. Magnetic circuit 5 is now inserted in the central space of frame 12, and bobbin 8 is placed in a manner that voice coil 7 is situated inside magnetic gap 6. Following the above process, bonding agent 14 is applied to an upper part of suspension holder 13 supported by jig 24. Afterwards, diaphragm 9 is placed on suspension holder 13, and diaphragm 9 is bonded to suspension holder 13 with bonding agent 14. Each head 24B of jig 24 has a shape analogous in cross section to a curved portion of inner rim 13A of suspension holder 13.

Description is now given of a material of jig 24. An exterior side of each head 24B is formed of a resin material having adhesive repelling property such as polyacetal resin. Heads 24B of jig 24 are formed of a material that is harder than frame 12, such as metal.

Bottom part 24A of jig 24 is L-shaped, and is secured in position by peripheral wall 12A of frame 12 covering the side of magnetic circuit 5 and back wall 12B covering the bottom of magnetic circuit 5.

The speaker manufactured according to the above processes can achieve high acoustic characteristics.

The first reason is that jig 24 can stabilize positioning of the individual components. In other words, openings 15 provided in frame 12 allow insertion of jig 24 for setting inner rim 13A of suspension holder 13 to the predetermined position. As a result, suspension holder 13 can be aligned properly when it is connected to frame 12. Suspension holder 13 is also kept steady when diaphragm 9 is bonded to it with bonding agent 14. For the above reasons, positions of bobbin 8 and voice coil 7 fixed to diaphragm 9 are kept steady within magnetic gap 6, which obviates degradation of the acoustic characteristics of the speaker.

Furthermore, since this method makes diaphragm 9 and suspension holder 13 into substantially same phase with each other, it reduces a resonance distortion in the mid- to low-frequency ranges which is attributed to a difference in the phase between diaphragm 9 and suspension holder 13. It thus flattens the frequency characteristic. As stated, the reliable positioning of the components attained by jig 24 provides the speaker with high acoustic characteristics.

The second reason is the shape of the heads of jig 24 which ensures steadiness in the positioning. In other words, each head 24B of jig 24 is formed into a ridge-like shape so as to fit the curved portion of inner rim 13A of suspension holder 13, and to locate precisely the bonding portion 16 where diaphragm 9 is bonded to suspension holder 13. As a result, this improves the acoustic characteristics.

The third reason is the shape of bottom part 24A of jig 24 which ensures proper positioning of it with respect to the bottom surface of frame 12. That is, bottom part 24A of jig 24 is L-shaped, as shown in FIG. 6, and is secured in position by two sides, each abutting on peripheral wall 12A and back wall 12B of frame 12 covering the magnetic circuit 5. Therefore, jig 24 and frame 12 fit securely with each other.

Jig 24 has a shape to stay standing as shown in FIG. 6 and FIG. 7A. Therefore, jig 24 can be moved while securely holding frame 12. In other words, frame 12 can be placed securely on fixed self-standing jig 24, since jig 24 has catches 26 for holding frame 12. Because of this structure, jig 24 can be moved from one workstation to another while keeping frame 12 held connected to jig 24 when they are transferred through different assembling processes, for instance. Accordingly, this movability in the process of assembly can improve productivity of the speaker of high acoustic characteristics.

It is desirable that the exterior sides of heads 24B of jig 24 are formed of polyacetal resin which is a resin material having adhesive repelling property. This material can prevent undesirable adhesion of a nearby component to jig 24 due to accidental contact with bonding agent 14 when bonding agent 14 is applied to bonding portion 16 of diaphragm 9 and suspension holder 13. It is also desirable that heads 24B of jig 24 are formed of a material that is harder than frame 12. Such material also improves productivity of the speaker. That is, jig 24 is not likely to get damaged if it is made of a harder material than frame 12, even after use in the manufacturing of a large number of speakers, and thereby this improves the productivity.

Described next pertains to the shape of heads 24B of jig 24. It is desirable that jig 24 has catch 26 on each of protruding portions 25 as shown in FIG. 7B.

In FIG. 6, jig 24 is set first into openings 15 of frame 12, and jig 24 is then turned toward a predetermined direction. Jig 24 is thus secured to frame 12 with catches 26 engaged to upper edges of openings 15.

Jig 24 and frame 12 are secured together by the engagement of catches 26 with openings 15 in the above manner. As a result, the speaker of this exemplary embodiment can be moved from one workstation to another while being secured to jig 24 when it is transferred through different assembling processes. It thus improves productivity of the speaker.

It is desirable in view of the manufacturing that annular-shaped magnetic body 27 of substantially equal diameter as protruding portions 25 of jig 24 is placed on top of diaphragm 9, as shown in FIG. 6, when diaphragm 9 is bonded to suspension holder 13. Magnetic body 27 placed in this manner holds diaphragm 9 on suspension holder 13. In other words, bonding between diaphragm 9 and suspension holder 13 can be made securely by bonding agent 14 since attractive force acting between magnetic body 27 and magnetic circuit 5 depresses diaphragm 9 against suspension holder 13 supported on jig 24. Magnetic body 27 can thus improve the productivity.

Second Exemplary Embodiment

Figure 8:
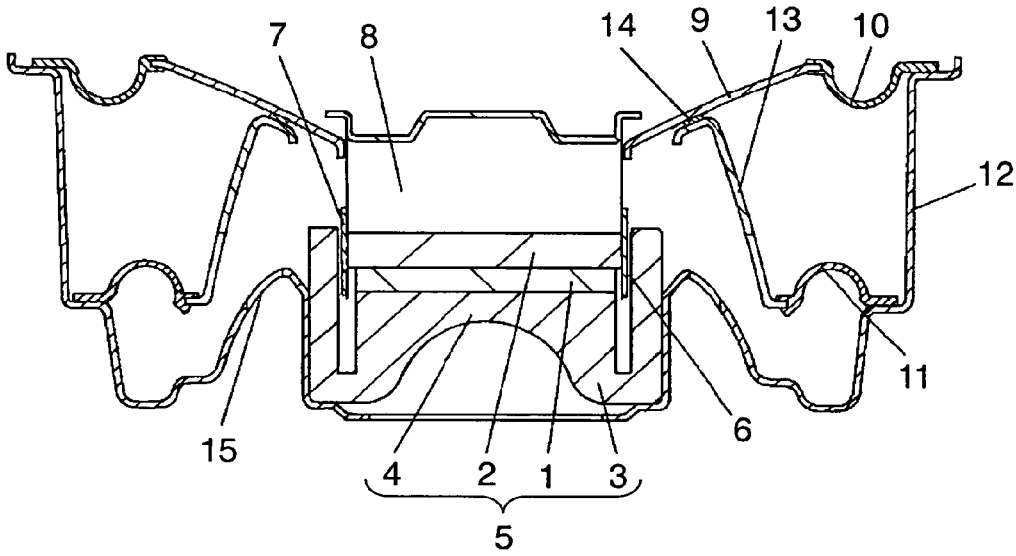
FIG. 8 is a sectional view of a speaker according to a second exemplary embodiment of the present invention.

FIG. 8 is a sectional view of a speaker according to the second exemplary embodiment of the present invention. Although the speaker of this exemplary embodiment is basically analogous to the speaker of the first exemplary embodiment, it differs from that of the first exemplary embodiment in respect of the directions to which first surround 10 and second surround 11 are formed to bulge. In the speaker of this exemplary embodiment, first surround 10 bulges in the direction toward the bottom side of magnetic circuit 5, and second surround 11 bulges toward diaphragm 9.

In the above structure, first surround 10 does not become obstructive to mounting the speaker even if there is no spatial margin in front of first surround 10 (i.e., upper side of the speaker drawn in FIG. 8). In an apparatus provided with a perforated net over and in close proximity of a sound opening where the speaker is mounted, for example, this structure can avoid first surround 10 from coming in contact with the perforated net even if the speaker is driven to a large amplitude of vibrations. This structure can thus increase the maximum sound pressure while achieving a low profile of the speaker.

Third Exemplary Embodiment

Figure 9:
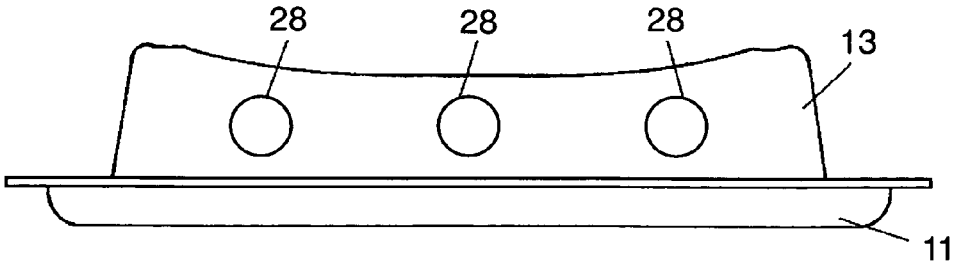
FIG. 9 is an exploded side view of a speaker according to a third exemplary embodiment of the present invention.

FIG. 9 is an exploded side view of a speaker according to the third exemplary embodiment of this invention. The speaker of this exemplary embodiment differs from that of the first exemplary embodiment in respect that suspension holder 13 is provided with openings 28 in its wall between the inner rim and the outer rim. Other components are analogous to those of the first exemplary embodiment.

These openings reduce an undesired sound output in the mid- to high-frequency ranges from suspension holder 13, and prevent degradation of acoustic characteristics of the speaker due to interference of the sound output of suspension holder 13 with sound of diaphragm 9. They can therefore improve the acoustic characteristics of the speaker.

Fourth Exemplary Embodiment

Figure 10:
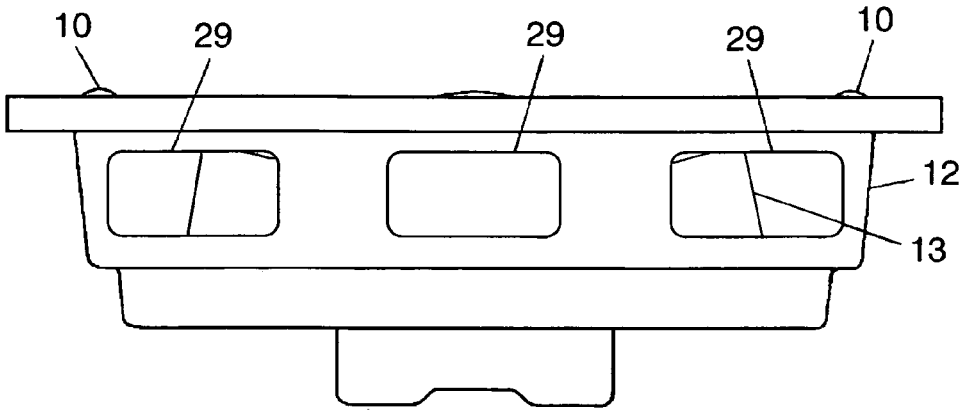
FIG. 10 is a side view of a speaker according to a fourth exemplary embodiment of the present invention.

FIG. 10 is a side view of a speaker according to the fourth exemplary embodiment of this invention. The speaker of this exemplary embodiment differs from that of the first exemplary embodiment in respect that frame 12 is provided with openings 29 in its sidewall facing a wall between the inner and outer rims of suspension holder 13. Other components are analogous to those of the first exemplary embodiment.

These openings break confinement of an inner chamber formed by diaphragm 9, first surround 10, second surround 11, frame 12 and suspension holder 13. This inner chamber, if closed, causes sound output of suspension holder 13 to interfere with the sound of diaphragm 9, and degrades the acoustic characteristics of the speaker. The openings prevent the interference and thereby improve the acoustic characteristics of the speaker.

Fifth Exemplary Embodiment

Figure 11:
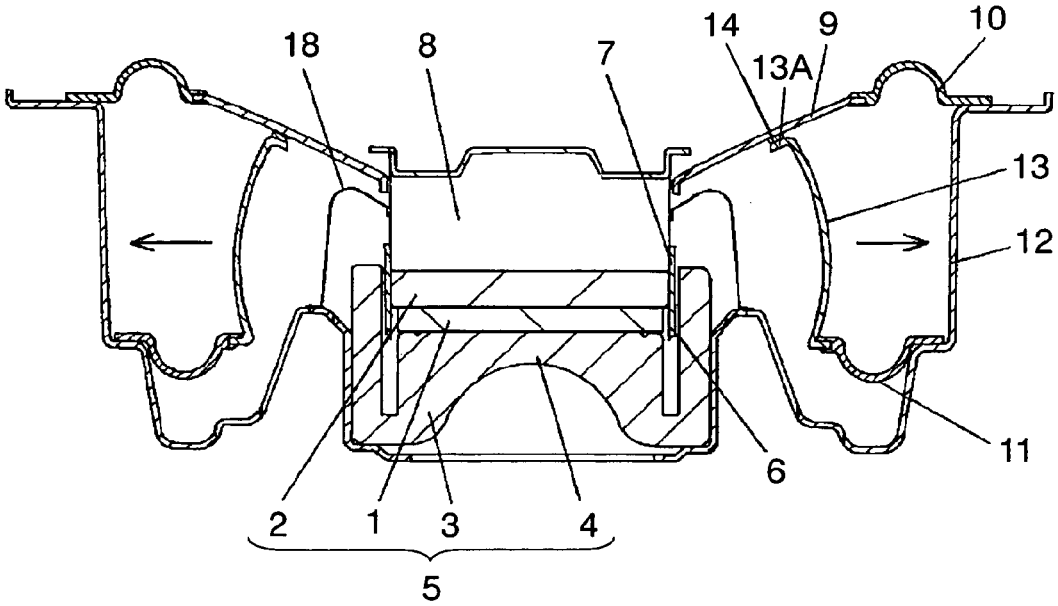
FIG. 11 is a sectional view of a speaker according to a fifth exemplary embodiment of the present invention.

FIG. 11 is a sectional view of a speaker according to the fifth exemplary embodiment of this invention. The speaker of this exemplary embodiment differs from that of the first exemplary embodiment in respect that a wall between the inner and outer rims of suspension holder 13 is outwardly curved. Other components are analogous to those of the first exemplary embodiment. Arrows in FIG. 11 indicate directions outward of suspension holder 13.

This structure improves rigidness of suspension holder 13 since the outwardly curved wall disperses the stress that tends to act upon suspension holder 13 in the outward direction. Consequentially, this structure improves the acoustic characteristics of the speaker. As an alternate structure, the wall between the inner and outer rims of suspension holder 13 may be curved inwardly to achieve the like advantageous effect.

Sixth Exemplary Embodiment

Figure 12:
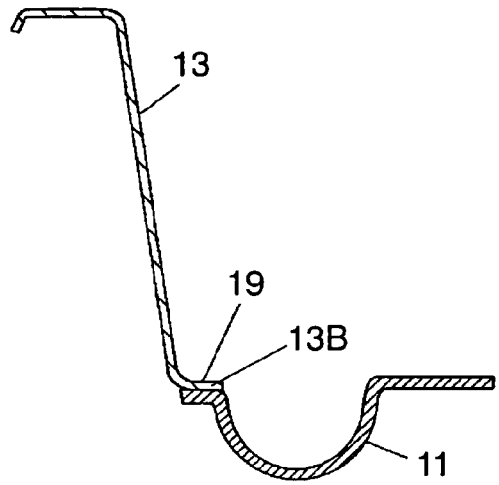
FIG. 12 is an enlarged sectional view of a portion of a speaker where a second surround and a suspension holder are bonded, according to a sixth exemplary embodiment of the present invention.

FIG. 12 is an enlarged sectional view of a portion of a speaker where second surround 11 and suspension holder 13 are connected according to the sixth exemplary embodiment of this invention. The speaker of this exemplary embodiment differs from that of the first exemplary embodiment in respect that outer rim 13B of suspension holder 13 is bent into a shape of the letter L, and flat part 19 of this bottom end is connected in a face-to-face abutment to second surround 11. Other components are analogous to those of the first exemplary embodiment.

This structure increases rigidness of the connected portion, and improves the effect of dispersing a physical stress applied to the connected portion between suspension holder 13 and second surround 11. This improves performance of the speaker to high input power and the acoustic characteristics of the speaker as a result.

Seventh Exemplary Embodiment

Figure 13:
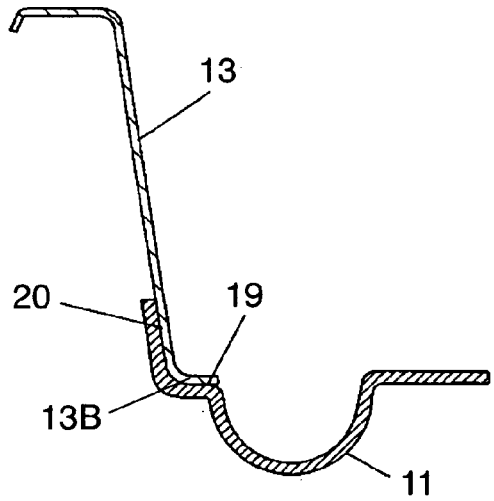
FIG. 13 is an enlarged sectional view of a portion of a speaker where a second surround and a suspension holder are bonded, according to a seventh exemplary embodiment of the present invention.

FIG. 13 is an enlarged sectional view of a portion of a speaker where second surround 11 and suspension holder 13 are connected according to the seventh exemplary embodiment of this invention. The speaker of this seventh exemplary embodiment differs from that of the first exemplary embodiment in respect that outer rim 13B of suspension holder 13 is bent into a shape of the letter L, and both faces of flat part 19 and angled adjoining part 20 are connected to second surround 11. Other components are analogous to those of the first exemplary embodiment.

This structure greatly increases the effect of dispersing the physical stress applied to the connected portion between suspension holder 13 and second surround 11. This improves performance of the speaker to high input power, and thus the acoustic characteristics of the speaker.

Eighth Exemplary Embodiment

Figure 14:
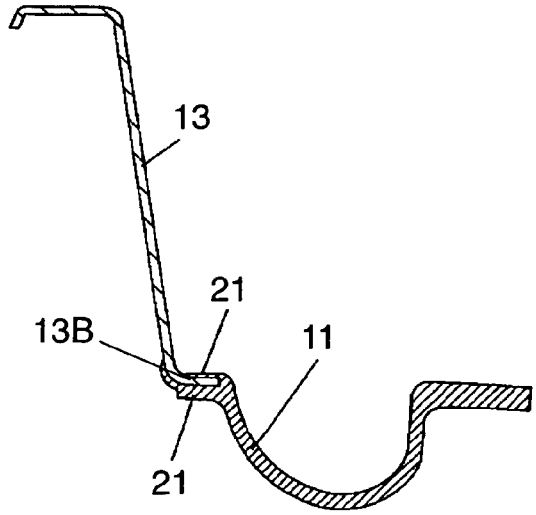
FIG. 14 is an enlarged sectional view of a portion of a speaker where a second surround and a suspension holder are bonded, according to an eighth exemplary embodiment of the present invention.

FIG. 14 is an enlarged sectional view of a portion of a speaker where second surround 11 and suspension holder 13 are connected according to the eighth exemplary embodiment of this invention. The speaker of this exemplary embodiment differs from that of the first exemplary embodiment in respect that suspension holder 13 is connected to second surround 11 in a manner that outer rim 13B is sandwiched between divided end flaps 21 of second surround 11. Other components are analogous to those of the first exemplary embodiment.

This structure also increases the effect of dispersing the physical stress applied to the connected portion between suspension holder 13 and second surround 11, and improves performance of the speaker to high input power. As a result, it improves the acoustic characteristics of the speaker.

Ninth Exemplary Embodiment

Figure 15:
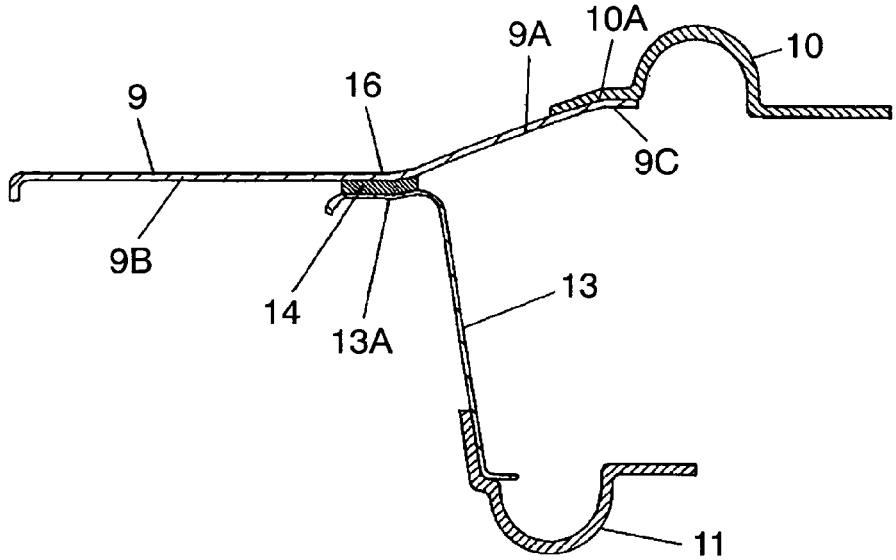
FIG. 15 is an enlarged sectional view of a portion of a speaker where a diaphragm and a suspension holder are bonded, according to a ninth exemplary embodiment of the present invention.

FIG. 15 is an enlarged sectional view of a portion of a speaker where diaphragm 9 and suspension holder 13 are bonded, according to the ninth exemplary embodiment of this invention. Although the speaker of this exemplary embodiment is basically analogous to that of the first exemplary embodiment, it differs in respect that outer side 9A of diaphragm 9 is formed low in density than inner side 9B. There is also a difference in respect that inner side 9B of diaphragm 9 is formed flat. In addition, outer side 9A of diaphragm. 9 is extended to form exterior rim 9C which is connected to first surround 10.

According to this structure in which density of outer side 9A from bonding portion 16 linking diaphragm 9 to suspension holder 13 is decreased as compared to density of inner side 9B, diaphragm 9 can be lightened in weight without sacrificing the rigidness. The structure can thus improve the acoustic characteristics of the speaker.

Moreover, inner side 9B of diaphragm 9 is formed flat. This can reduce a front-to-back height of diaphragm 9, thereby achieving low-profiling of the speaker.

Furthermore, diaphragm 9 is provided with obtusely angled exterior rim 9C throughout the perimeter of outer side 9A, and inner edge 10A of first surround 10 is also obtusely angled as shown in FIG. 15. Since these portions become substantially similar in shape to the connecting portion between suspension holder 13 and second surround 11, they improve the acoustic characteristics of the speaker.

Tenth Exemplary Embodiment

Figure 16:
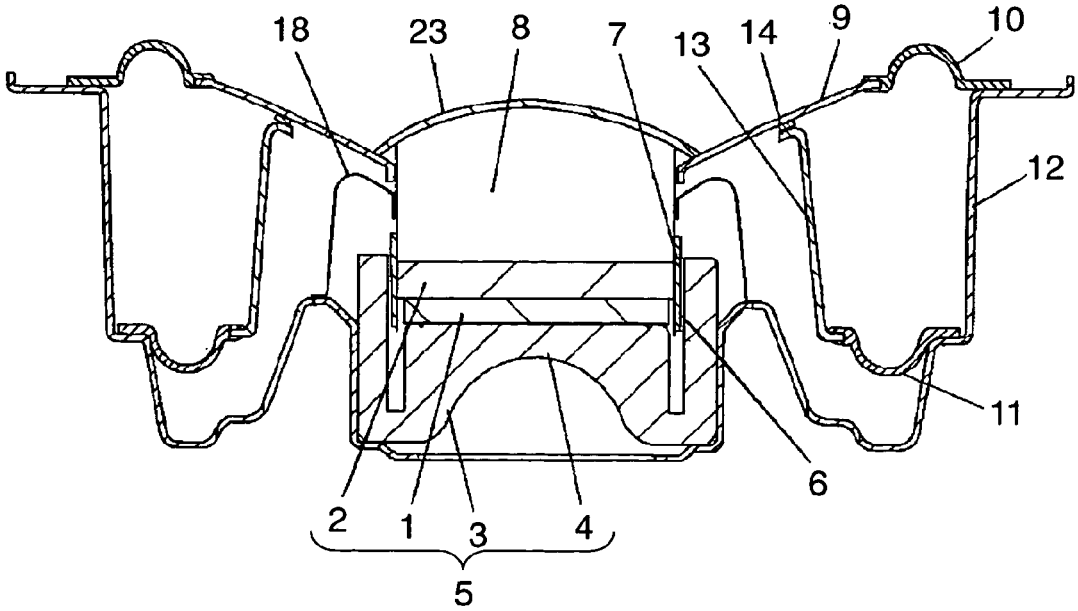
FIG. 16 is a sectional view of a speaker according to a tenth exemplary embodiment of the present invention.
Figure 17:
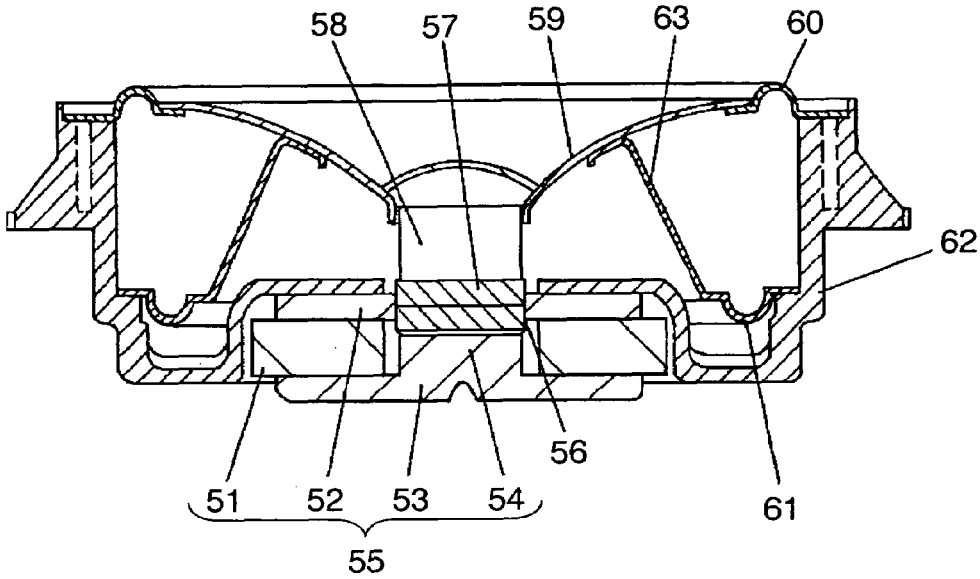
FIG. 17 PRIOR ART
FIG. 17 is a sectional view of a conventional speaker.

FIG. 16 is a sectional view of a speaker according to the tenth exemplary embodiment of this invention. The speaker of this tenth exemplary embodiment differs from that of the first exemplary embodiment in respect that it is provided with dust cap 23. Other components are analogous to those of the first exemplary embodiment.

Dust cap 23 is bonded to both bobbin 8 and diaphragm 9 with adhesive (not show in the figure) in a manner to cover the connected area between bobbin 8 and diaphragm 9. Dust cap 23 is made primarily of pulp or plastic resin, and the adhesive used here is generally any of acrylic-base, silicone-base, rubber-base, and the like material.

The above structure prevents dust and the like from getting into magnetic gap 6 within magnetic circuit 5. It also increases a bonding strength between bobbin 8 and diaphragm 9, which improves a dynamic balance of bobbin 8 in the moving directions toward the inside and the outside of magnetic circuit 5. Since this structure accurately transmits a driving force of voice coil 7 to diaphragm 9, it decreases a level of distortion and improves the acoustic characteristics of the speaker.

As discussed above, the present invention can provide the speaker of high acoustic performance which is useful for a variety of acoustic apparatuses in all fields.

What is claimed is:

1. A speaker comprising:

a magnetic circuit provided with a magnetic gap;

a bobbin having a voice coil, the voice coil disposed in the magnetic gap;

a diaphragm having an inner perimeter and an outer perimeter, the inner perimeter being connected to an outer periphery of the bobbin;

a frame serving an exterior enclosure, and retaining therein the magnetic circuit;

a first surround connecting the outer perimeter of the diaphragm to the frame;

a second surround connected to the frame;

a suspension holder having an inner rim and an outer rim, the inner rim supporting the diaphragm, and the outer rim connected to the frame through the second surround; and a bonding agent bonding the inner rim of the suspension holder to the diaphragm, wherein the frame is provided with an opening in a position corresponding to the bonding agent.

2. The speaker according to claim 1 further comprising a dustproof net covering the opening.

3. The speaker according to claim 1 further comprising a dustproof net provided between the suspension holder and the magnetic circuit.

4. The speaker according to claim 1, wherein the first surround and the second surround are substantially similar in shape and arranged symmetrically with respect to each other.

5. The speaker according to claim 4, wherein the first surround is formed to bulge in a direction opposite the magnetic circuit, and the second surround is formed to bulge toward the bottom side of the magnetic circuit.

6. The speaker according to claim 4, wherein the first surround is formed to bulge in a direction toward the magnetic circuit, and the second surround is formed to bulge in a direction toward the diaphragm.

7. The speaker according to claim 4, wherein both the first surround and the second surround are substantially equal in modulus of elasticity.

8. The speaker according to claim 1, wherein the inner rim of the suspension holder is bonded to a mid area of the diaphragm.

9. The speaker according to claim 1, wherein bonding of the inner rim of the suspension holder to the diaphragm is made primarily in an area around outer edge of the inner rim closer to the first diaphragm.

10. The speaker according to claim 1, wherein the magnetic circuit comprises a plate, a magnet and a yoke laid up in this order from the diaphragm side, and the outer rim of the suspension holder is connected through the second surround to the frame at a position close to the bottom side of the yoke and far from the plate side.

11. The speaker according to claim 1, wherein the suspension holder is provided with an opening in a wall between the inner rim and the outer rim.

12. The speaker according to claim 1, wherein the frame is provided with an opening in a sidewall facing a wall between the inner rim and the outer rim of the suspension holder.

13. The speaker according to claim 1, wherein a wall between the inner rim and the outer rim of the suspension holder is curved toward one of the outside and inside.

14. The speaker according to claim 1, wherein the outer rim of the suspension holder is bent into a shape of the letter L having a flat part at the bottom end, and the flat part is connected to the second surround.

15. The speaker according to claim 1, wherein the outer rim of the suspension holder is bent into a shape of the letter L having a flat part and an angled adjoining part, and both faces of the flat part and the angled adjoining part are connected to the second surround.

16. The speaker according to claim 1, wherein the outer rim of the suspension holder is connected to second surround by being sandwiched between divided end flaps formed at an inner rim of the second surround.

17. The speaker according to claim 1, wherein an outer side of the diaphragm beyond a bonding portion to the suspension holder is formed low in density than an inner side thereof.

18. The speaker according to claim 1, wherein an inner side of the diaphragm is formed flat.

19. The speaker according to claim 1, wherein the outer perimeter of the diaphragm is obtusely angled.

20. The speaker according to claim 1 further comprising a dust cap bonded to the diaphragm in a manner to cover a connected area between the bobbin and the diaphragm.

21. The speaker according to claim 1, wherein the first surround and the second surround are formed of urethane.

22. The speaker according to claim 1, wherein the first surround and the second surround are formed of rubber.

23. The speaker according to claim 1, wherein the bobbin and the suspension holder are formed individually of a metallic material.

24. The speaker according to claim 1, wherein the suspension holder is formed of a pulp material.

25. The speaker according to claim 1, wherein the bonding agent is made of a silicon-base adhesive.

* * * * *